US007726126B1

(12) United States Patent
Hauser et al.

(10) Patent No.: US 7,726,126 B1
(45) **Date of Patent: *Jun. 1, 2010**

(54) DUAL PUMP APPARATUS WITH POWER TAKE OFF

(75) Inventors: Raymond Hauser, Sullivan, IL (US); Michael L. Bennett, Sullivan, IL (US)

(73) Assignee: Hydro-Gear Limited Partnership, Sullivan, IL (US)

( * ) Notice: Subject to any disclaimer, the term of this patent is extended or adjusted under 35 U.S.C. 154(b) by 312 days.

This patent is subject to a terminal disclaimer.

(21) Appl. No.: 11/780,934

(22) Filed: Jul. 20, 2007

Related U.S. Application Data

(63) Continuation-in-part of application No. 11/316,314, filed on Dec. 21, 2005, now Pat. No. 7,257,948.

(51) Int. Cl.
*F04B 1/22* (2006.01)
*F04B 23/00* (2006.01)

(52) U.S. Cl. ..... 60/486; 60/488

(58) Field of Classification Search ..... 60/486, 60/488

See application file for complete search history.

(56) References Cited

U.S. PATENT DOCUMENTS

| | | | | |
|---|---|---|---|---|
| 1,539,616 | A | 5/1925 | Williams | |
| 3,177,666 | A | 4/1965 | Reinke | |
| 3,362,161 | A | 1/1968 | Flint | |
| 3,922,931 | A | 12/1975 | Osujyo et al. | |
| 4,534,271 | A | 8/1985 | Forster | |
| 5,207,060 | A | 5/1993 | Sheets | |
| 5,354,180 | A | 10/1994 | Forster | |
| 5,800,134 | A | 9/1998 | Hasegawa et al. | |
| 5,913,950 | A | 6/1999 | Matsufuji | |
| 5,957,666 | A | 9/1999 | Lee | |
| 6,007,444 | A | 12/1999 | Kinokami | |
| 6,022,198 | A | 2/2000 | Hoffmeister | |
| 6,332,393 | B1 | 12/2001 | Trimble | |
| 6,361,282 | B1 * | 3/2002 | Wanschura | 92/71 |
| 6,474,218 | B2 | 11/2002 | Saito et al. | |

(Continued)

FOREIGN PATENT DOCUMENTS

EP 1473183 A2 11/2004

(Continued)

OTHER PUBLICATIONS

Dixie Choper The World's Fastest Lawn Mower, Operation Manual 1998, pp. 1, 50-51, 60-61, and 66.

*Primary Examiner*—Thomas E Lazo
(74) *Attorney, Agent, or Firm*—Neal Gerber & Eisenberg LLP

(57) ABSTRACT

A drive apparatus includes a pair of axial piston pump assemblies in an inline relationship, each pump assembly having an end cap mounted to a pump housing to form a sump. The pump assemblies are mounted to a gearbox at one end thereof, and an input shaft extends into both pump housings and the gearbox to drive the axial piston pumps and one of the gears. A power take off mechanism is also engaged to the gearbox at another end thereof and includes a drive shaft at least partially disposed in the gearbox and driven by one of the transmission gears, and an output shaft extending in the opposite direction from the drive shaft.

44 Claims, 11 Drawing Sheets

U.S. PATENT DOCUMENTS

| | | | | |
|---|---|---|---|---|
| 6,487,856 | B1 | 12/2002 | Ohashi et al. | |
| 6,494,686 | B1 | 12/2002 | Ward | |
| 6,682,312 | B1 | 1/2004 | Ward | |
| 6,705,840 | B1 | 3/2004 | Hauser et al. | |
| 6,736,605 | B2 | 5/2004 | Ohashi et al. | |
| 6,793,463 | B1 | 9/2004 | Ward | |
| 6,973,783 | B1 | 12/2005 | Hauser et al. | |
| 6,988,580 | B2 | 1/2006 | Ohashi et al. | |
| 7,137,250 | B1 | 11/2006 | McCoy et al. | |
| 7,231,765 | B2 | 6/2007 | Kawamura et al. | |
| 7,257,948 | B1 * | 8/2007 | Bennett | 60/486 |
| 7,334,404 | B2 * | 2/2008 | Sakikawa et al. | 60/486 |
| 7,367,185 | B1 | 5/2008 | McCoy et al. | |
| 7,392,654 | B1 | 7/2008 | Hauser et al. | |
| 7,536,857 | B1 | 5/2009 | Hauser et al. | |
| 2004/0237490 | A1 | 12/2004 | Yasuda et al. | |
| 2005/0287013 | A1 | 12/2005 | Sakikawa et al. | |
| 2006/0042843 | A1 | 3/2006 | Yasuda et al. | |
| 2006/0090639 | A1 | 5/2006 | Dong et al. | |
| 2007/0006581 | A1 | 1/2007 | Ohashi et al. | |

FOREIGN PATENT DOCUMENTS

| | | |
|---|---|---|
| JP | 2000009023 A | 1/2000 |
| JP | 2001-146951 | 5/2001 |
| JP | 2001-263259 | 9/2001 |
| WO | WO 99/67532 | 12/1999 |

* cited by examiner

DUAL PUMP APPARATUS WITH POWER TAKE OFF

CROSS-REFERENCE

This application is a continuation-in-part of U.S. patent application Ser. No. 11/316,314 filed on Dec. 21, 2005 and entitled Dual Pump Apparatus, which is incorporated by reference herein in its entirety.

BACKGROUND OF THE INVENTION

This application relates to hydraulic pumps in general; to a dual pump apparatus more particularly, and further, to a dual pump apparatus with power take off.

Hydraulic pump assemblies with power take offs are known in the art. Commonly owned U.S. Pat. No. 7,137,250, whose terms are incorporated by reference herein, discloses a dual pump apparatus with power take off, wherein the input shaft extends through a central gearbox in which it orthogonally engages opposing pump shafts to thereafter selectively engage a collinear, power take off shaft.

SUMMARY OF THE INVENTION

The present invention comprises a dual pump apparatus having multiple housing members and sumps and a single charge pump preferably located between the two pumps. The two pumps and the charge pump are preferably driven by a unitary pump input shaft.

A further aspect of the present invention utilizes the advantages of that compact assembly by integrating a power take off driven by the unitary input shaft through transmission gearing.

A better understanding of the objects, advantages, feature, properties and relationships of the invention will be obtained from the following detailed description and accompanying drawings which set forth illustrative embodiments and are indicative of the various ways in which the principles of the invention may be employed.

DETAILED DESCRIPTION OF THE DRAWINGS

Figure 1:
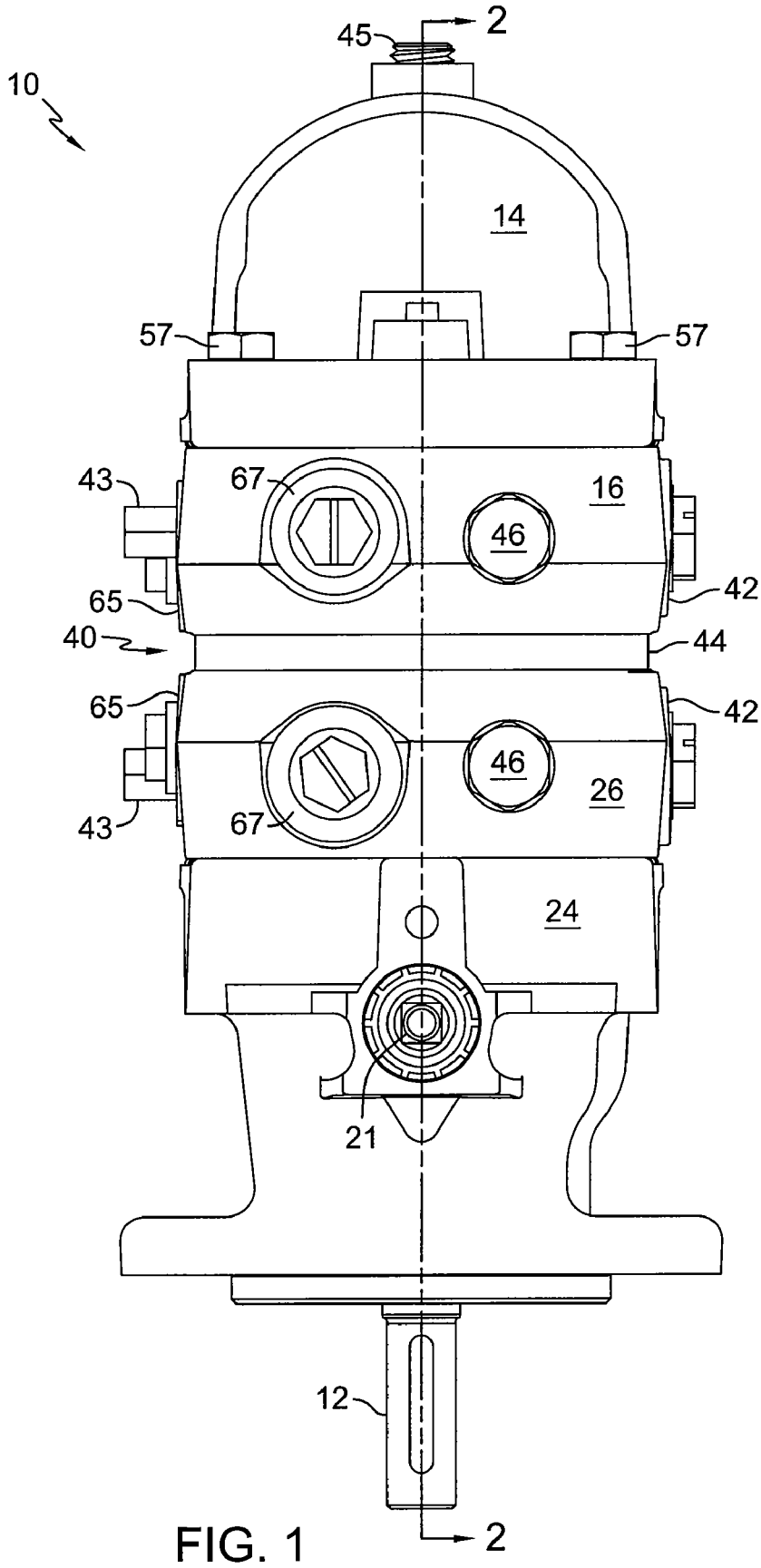
FIG. 1 is an elevational view of a dual pump apparatus in accordance with a first embodiment of the present invention.
Figure 2:
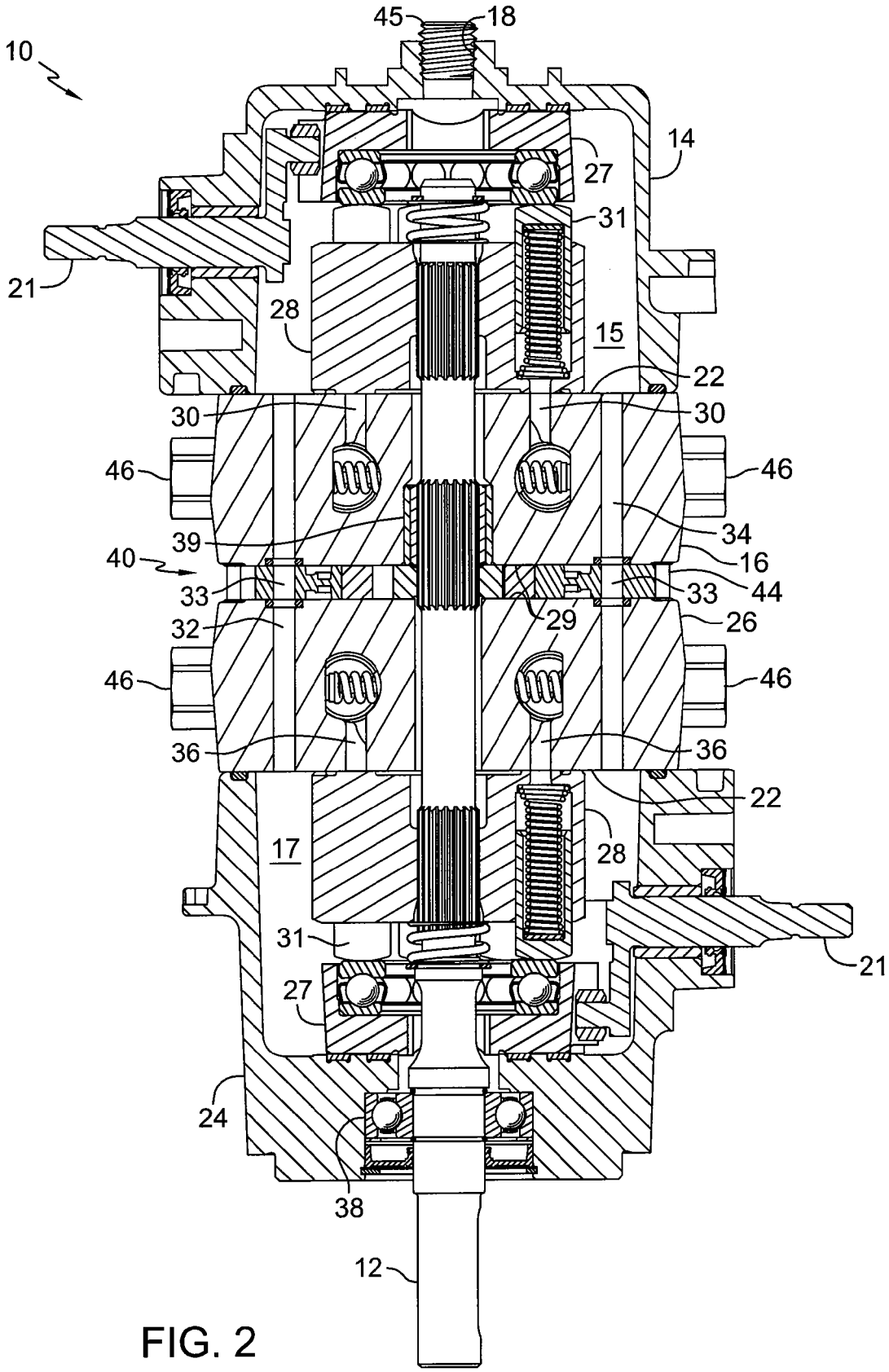
FIG. 2 is a cross-sectional view of the dual pump apparatus along the lines 2-2 of FIG. 1.
Figure 3:
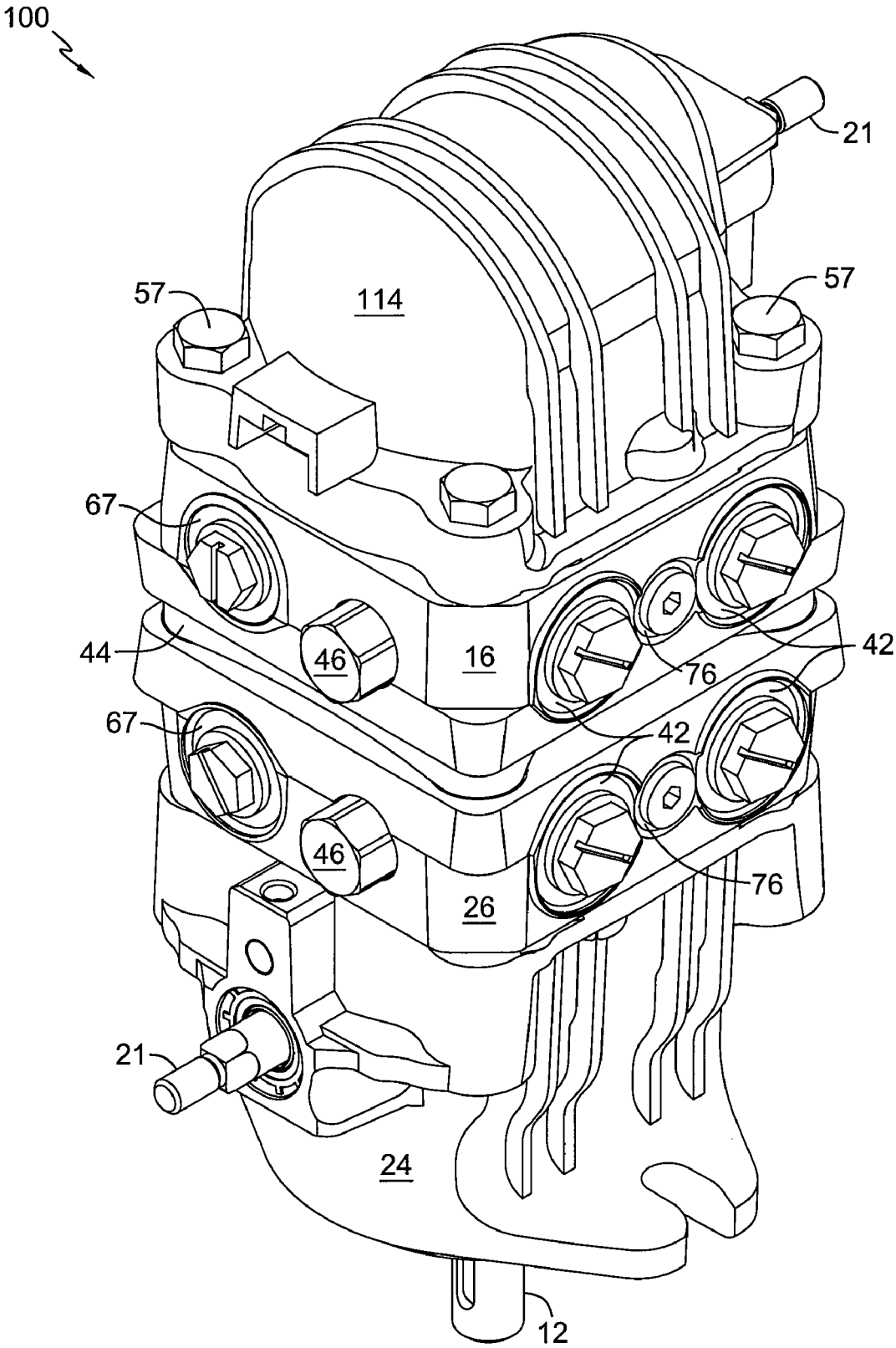
FIG. 3 is a perspective view of a dual pump apparatus in accordance with a second embodiment of this invention.
Figure 4:
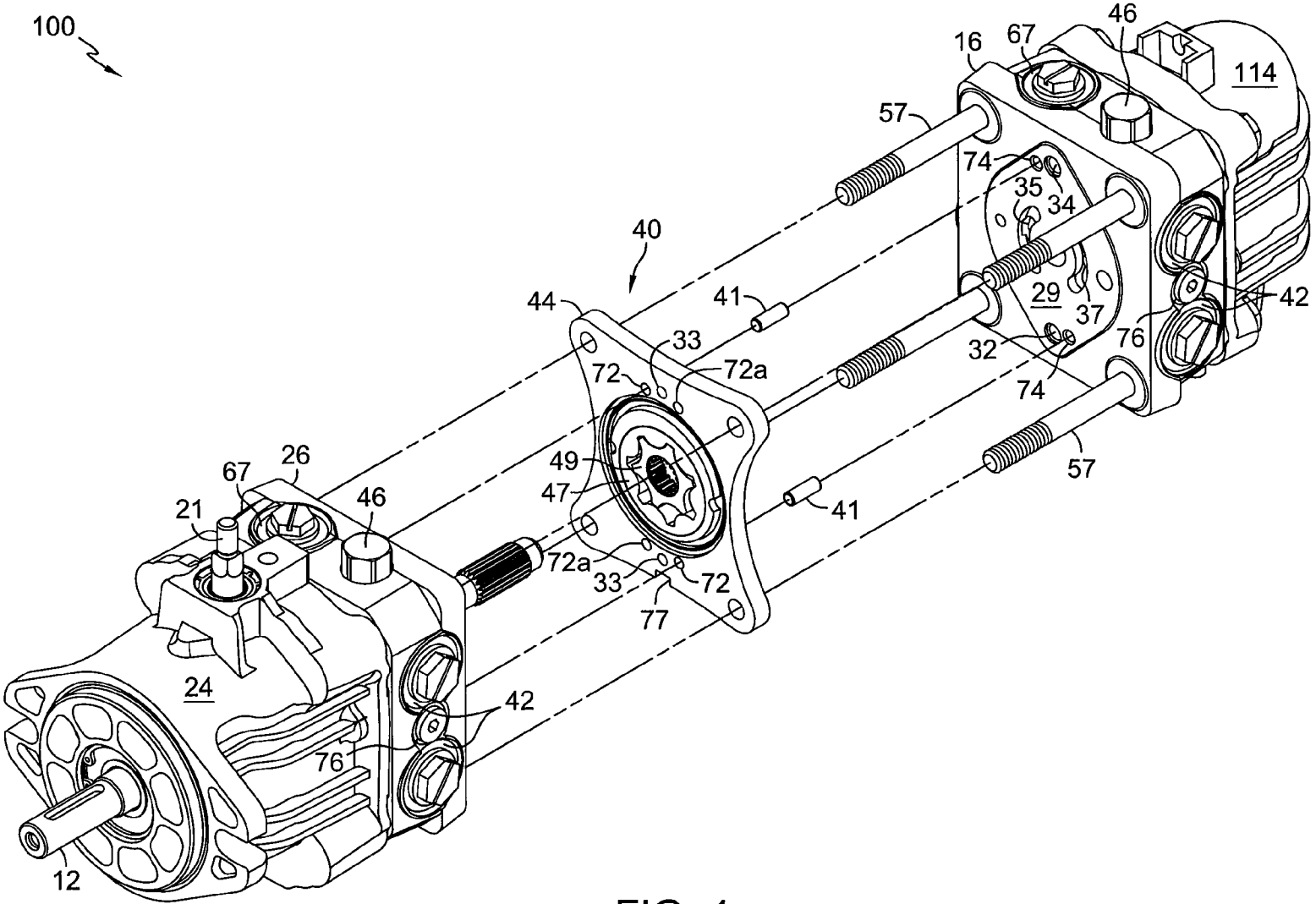
FIG. 4 is an exploded view of the dual pump apparatus shown in FIG. 3.
Figure 6:
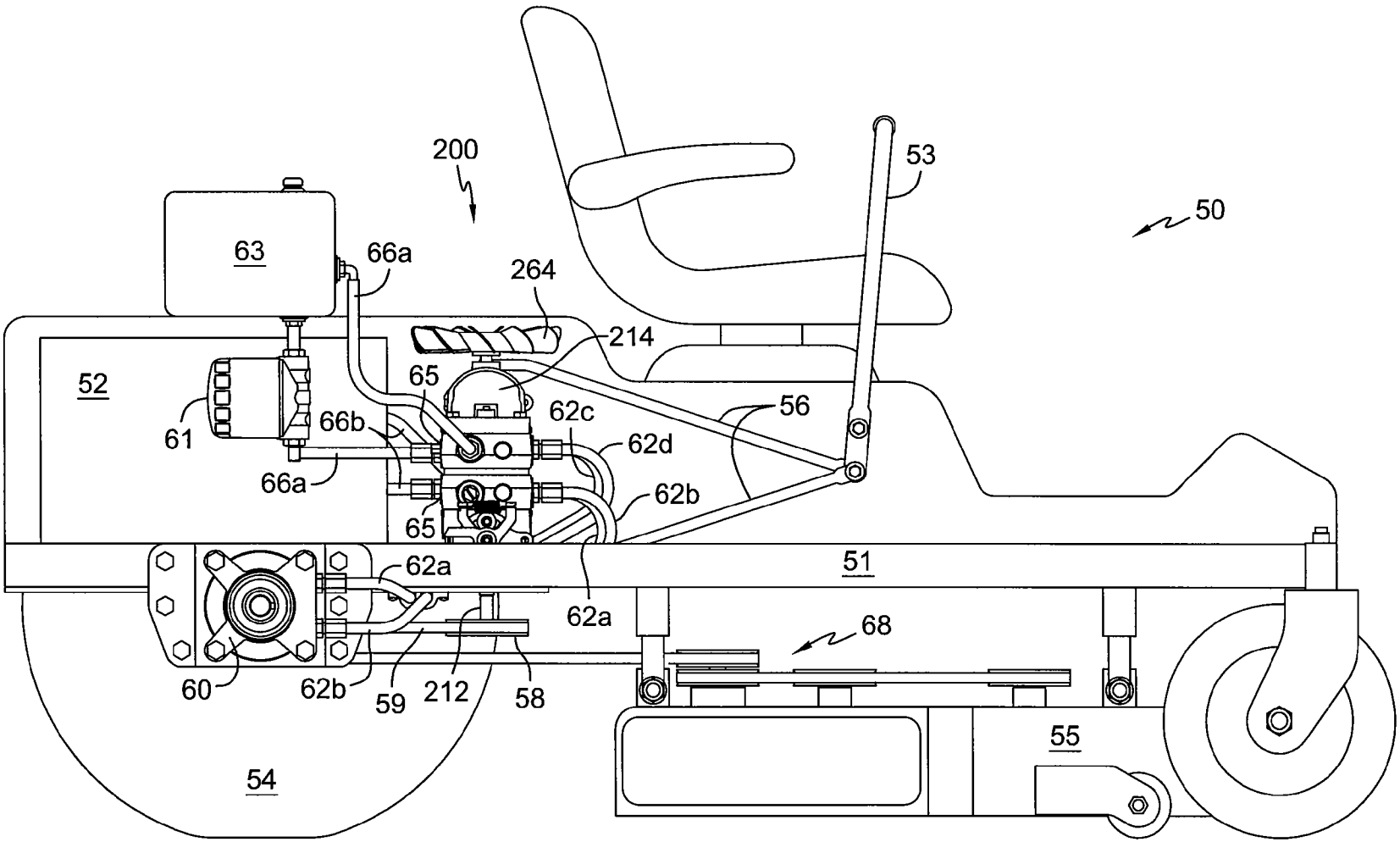
FIG. 6 is an elevational view of an exemplary vehicle incorporating a dual pump apparatus in accordance with a further embodiment of the present invention, with certain features such as a wheel removed to show other aspects of the invention.

FIGS. 1 and 2 show a dual pump apparatus 10 in accordance with a first embodiment of the present invention. FIGS. 3 and 4 show an alternative embodiment dual pump apparatus 100, which is similar to that of FIGS. 1 and 2 in most respects except in the structure of housing 114. In FIGS. 1 and 2, housing 14 includes an access hole 18 to assist in the final assembly of the unit; plug 45 is then placed in access hole 18 for operation. This optional access hole is not included in housing 114 of FIG. 4. In both embodiments, input shaft 12 does not extend out of housing 14 or housing 114. The application view of FIG. 6 depicts a further alternative embodiment dual pump apparatus 200, where input shaft 212 is a through-shaft extending out of housing 214 to power cooling fan 264. Since these embodiments are generally identical otherwise, the invention will be described herein with respect to the embodiments shown in FIGS. 1-4.

As shown most clearly in FIG. 2, this apparatus includes a single pump input shaft 12 that drives both pumps. A first pump apparatus comprises housing 14 secured to a porting member such as end cap 16 to form internal sump 15; such porting members are also sometimes referred to as center sections. The second pump apparatus similarly comprises housing 24 secured to end cap 26 to form internal sump 17. In a preferred embodiment, a single set of fasteners 57 is used to connect the various housings, end caps and charge pump 40 together as shown most clearly in FIG. 4.

Within the two internal sumps 15 and 17 are mounted preferably identical hydraulic cylinder blocks 28 rotatably mounted on a pump running surface 22 formed on the respective end caps 16, 26. A valve plate (not shown) may also be disposed on end caps 16, 26 to provide a running surface for cylinder blocks 28. When a pump is described as being disposed on or mounted on a running surface, it is generally understood to include either direct mounting thereon or including a valve plate between the cylinder block (or gerotor) and the running surface. A plurality of pistons 31 are mounted within the cylinder blocks 28 and are engaged to a swash plate assembly 27 which is moved by means of a control shaft or trunnion arm 21. Both cylinder blocks 28 are preferably splined to and driven by single pump input shaft 12. The general arrangement of the hydraulic cylinder blocks, control arms and related structure is well-known in the art and will not be described further herein. In addition, various bearings 38 and 39 may be included as needed depending on the application.

End cap 16 includes hydraulic porting 30 while end cap 26 includes hydraulic porting 36; in both instances, the hydraulic porting is intended to connect the cylinder blocks 28 to external hydraulic lines and charge pump 40, all of which will be described herein. In FIG. 2, one can see two separate fluid passages 32 and 34 which include openings 33 formed in charge pump housing or plate 44, intended to provide a line of fluid communication between sumps 15 and 17. In practice, only one such case drain is necessary in most applications, but two case drains are being depicted here to show flexibility in the location of the case drain. Each end cap will preferably include a pair of system ports 42 (shown in FIGS. 1, 3 and 4 with a shipping plug installed), a pair of case drains 67 (shown in FIGS. 1, 3, and 4 with a shipping plug installed), a charge diagnostic port 76 (shown in FIGS. 3 and 4 with an SAE plug installed), a bypass valve 43 and a pair of check valves 46.

Figure 5:
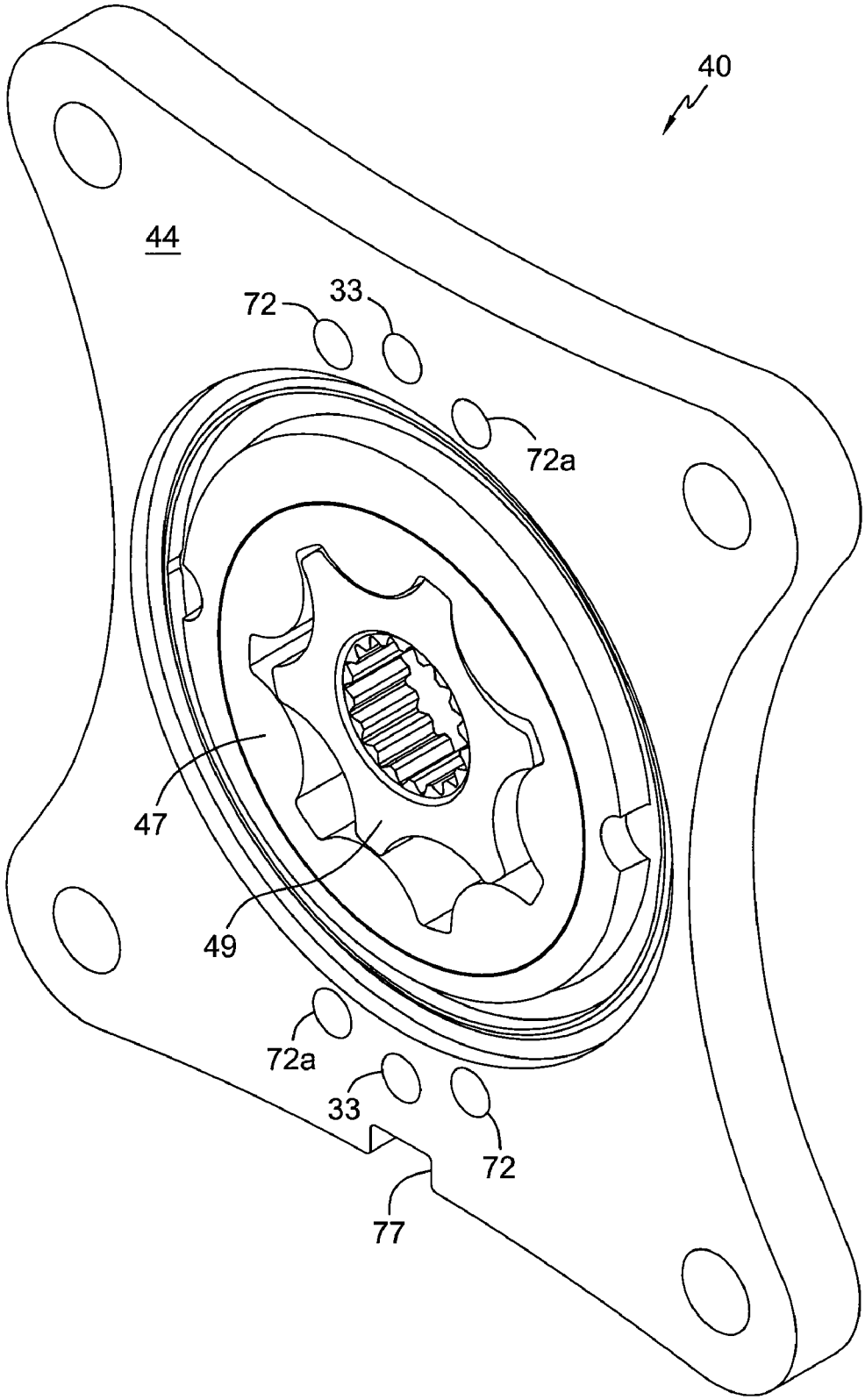
FIG. 5 is a perspective view of the charge pump and its housing in accordance with this invention.

Charge pump 40 is preferably sandwiched between the external surfaces of end caps 16 and 26 and, as shown, comprises a gerotor pump further comprising outer gerotor element 47 and inner gerotor element 49 engaged to and also driven by pump input shaft 12. Charge pump 40, shown most clearly in FIGS. 4 and 5, comprises housing plate 44 sandwiched between end caps 16 and 26, and secured by means of fasteners 57. This design eliminates the need for a separate intermediate member between the two end caps 16, 26. A charge pump running surface 29 is formed on the outer side of end cap 16, opposite to pump running surface 22; a similar charge pump running surface is formed on end cap 26. The two piece gerotor assembly 47, 49 is powered by input shaft 12 through a spline and provides charge fluid to both hydraulic porting 30 in end cap 16 and hydraulic porting 36 in end cap 26. Using end cap 16 as an example, fluid flows from a reservoir 63, as shown in FIG. 6 into one or more inlets 65, which are shown with shipping plugs installed in FIG. 1, then into port 35 and into gerotor assembly 47, 49. The output of gerotor assembly 47, 49 flows into inlet 37 and then into a charge gallery (not shown). Charge galleries are known and are described in, for example, U.S. Pat. No. 6,889,595, the terms of which are incorporated herein by reference.

To assist in the positioning of housing plate 44, a pair of pins 41 may extend through holes 72 and into a set of openings 74 formed on charge pump running surface 29 of end cap 16 to locate pins 41. Another set of similar openings are formed on the charge pump running surface (not shown) of end cap 26. An alternative set of holes 72*a* may also be formed in housing plate 44 so that charge pump 40 may be rotated 180 degrees with respect to input shaft 12 to increase the flexibility of the unit. As an example, rotation of housing plate 44 by 180° with respect to end caps 16, 26 may allow the direction of rotation of shaft 12 to be reversed. To prevent improper assembly, a notch 77 is provided on one side of housing plate 44 to serve as a visual aid to achieve the desired orientation during assembly. It will also be understood that pump housings 14, 114 and 214 in the various embodiments depicted herein, along with the respective swash plate 27 and trunnion arm 21, may be rotated 180 degrees about the axis of input shaft 12 or 212 so that both trunnion arms 21 are on the same side of the unit.

A preferred application for dual pump apparatus 200 is shown in FIG. 6, where exemplary vehicle 50 is depicted having a prime mover 52 mounted on frame 51. One drive wheel 54 of vehicle 50 was removed so that one can see the arrangement of the various drive elements. Dual pump apparatus 200 is also mounted on frame 51 and pump input shaft 212 can be seen as being driven by pulley 58, which is powered by belt 59 from prime mover 52. Pump apparatus 200 could also be mounted horizontally in vehicle 50 for direct drive by prime mover 52.

As discussed previously, cooling fan 264 is mounted on and powered by pump input shaft 212, which is a through-shaft in this embodiment. Mower deck 55 is also shown as being mounted on frame 51 and is powered by belt and pulley assembly 68 in a known manner. A hydraulic motor 60 is shown for powering the drive wheels 54; the other hydraulic motor is not shown. Motor 60 is connected to end cap 26 through hydraulic lines 62*a* and 62*b*, and lines 62*c* and 62*d* connect end cap 16 to the second hydraulic motor (not shown). Additional hydraulic lines 66*a* and 66*b* connect at least one case drain port 67 of hydraulic pump apparatus 200 to reservoir 63 and include a connection to oil filter 61. Note that only one case drain port 67 need be used if at least one fluid passage 32, 34 is available to connect the fluid sumps contained within housing 24 and within housing 14, 114 or 214.

The exemplary vehicle 50 also includes linkage 56 attached to control arm 53 for connecting pump apparatus 200 and for enabling control by the user. It will be understood that this exemplary application includes various features which are preferred but which are not critical to the use of the invention disclosed herein.

FIGS. 7-11 depict further embodiments of the present invention, wherein a power take off is integrated into the dual pump apparatus. It is to be understood that each of these embodiments shares the unitary shaft, dual pump, sandwiched charge pump geometry and function previously detailed. Further discussion of these aspects of the successive embodiments will not be made herein. For clarity, common elements in FIGS. 7-11 have been labeled identically to their counterparts in FIGS. 1-6, whereas similar elements in successive embodiments are labeled with sequential numerical prefixes. For each of the embodiments depicted in FIGS. 7-11, the dual pumps' trunnion arms 21 are preferably oriented to the same side of the unit, opposite the power take off. This arrangement provides necessary clearances for the dual pumps' control linkages.

Figure 7:
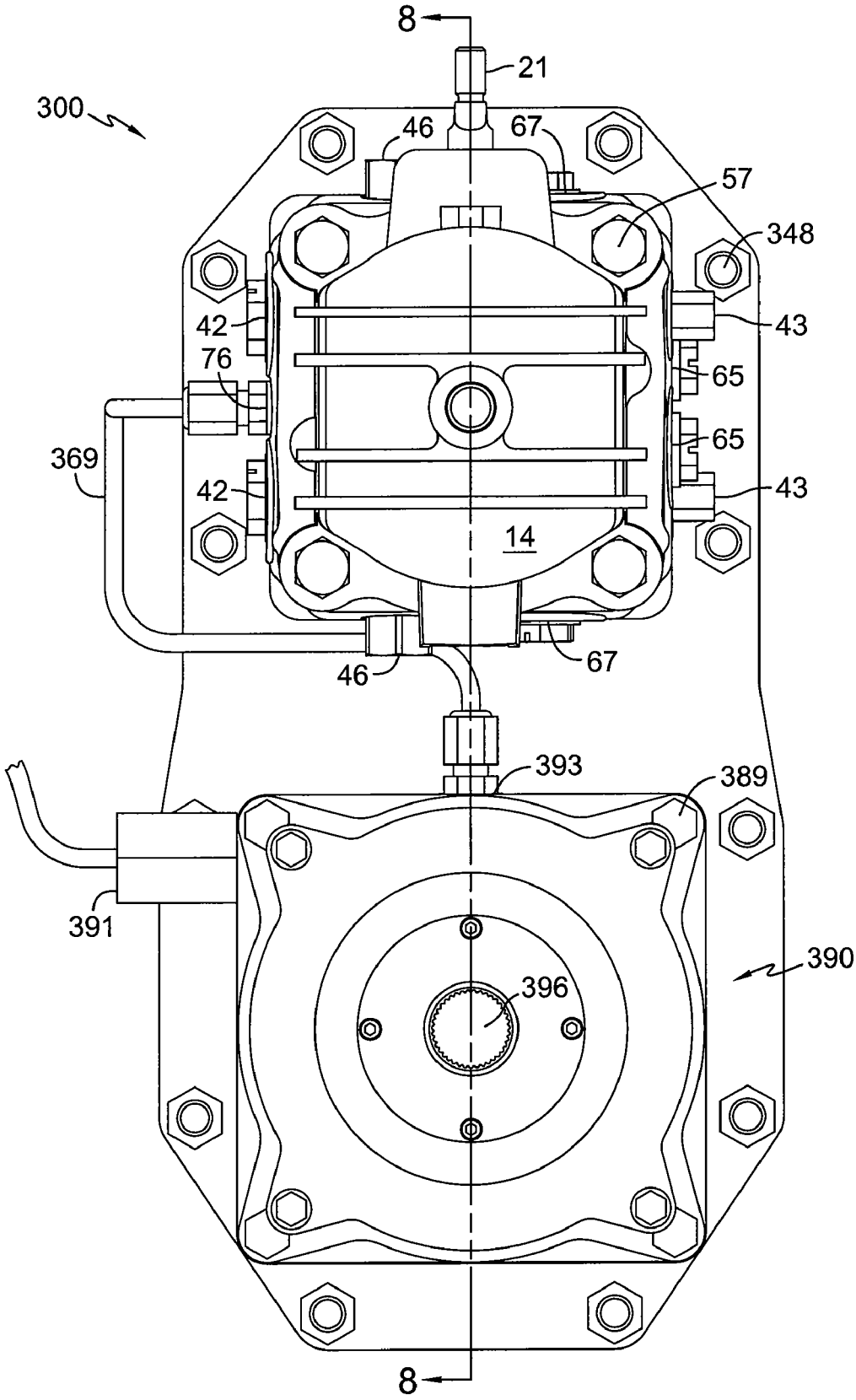
FIG. 7 is an elevational view of a dual pump apparatus with power take off in accordance with a fourth embodiment of the present invention.
Figure 8:
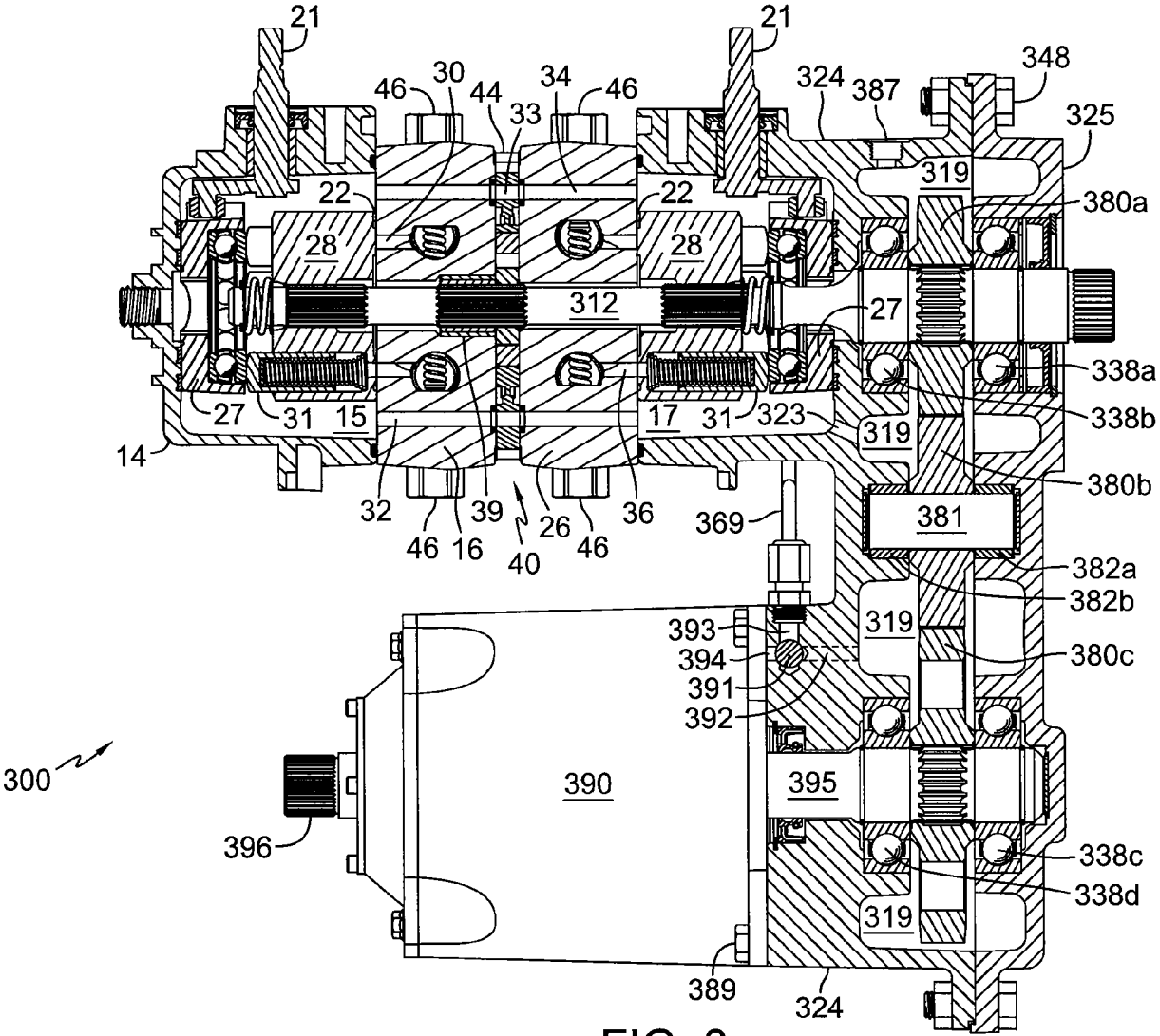
FIG. 8 is a partial cross-sectional view of the fourth embodiment of the present invention along the lines 8-8 of FIG. 7

Variations between the embodiments depicted in FIGS. 7-11 are related to the configuration of the power take off, the housing elements necessary to incorporate the power take off, and the manner in which the power take off is actuated. For example, dual pump apparatus 300, as depicted in FIGS. 7 and 8, illustrates a fourth embodiment of the present invention in which a hydraulic power take off 390 receives hydraulic fluid pressurized by charge pump 40 via an external supply line 369.

Figure 9:
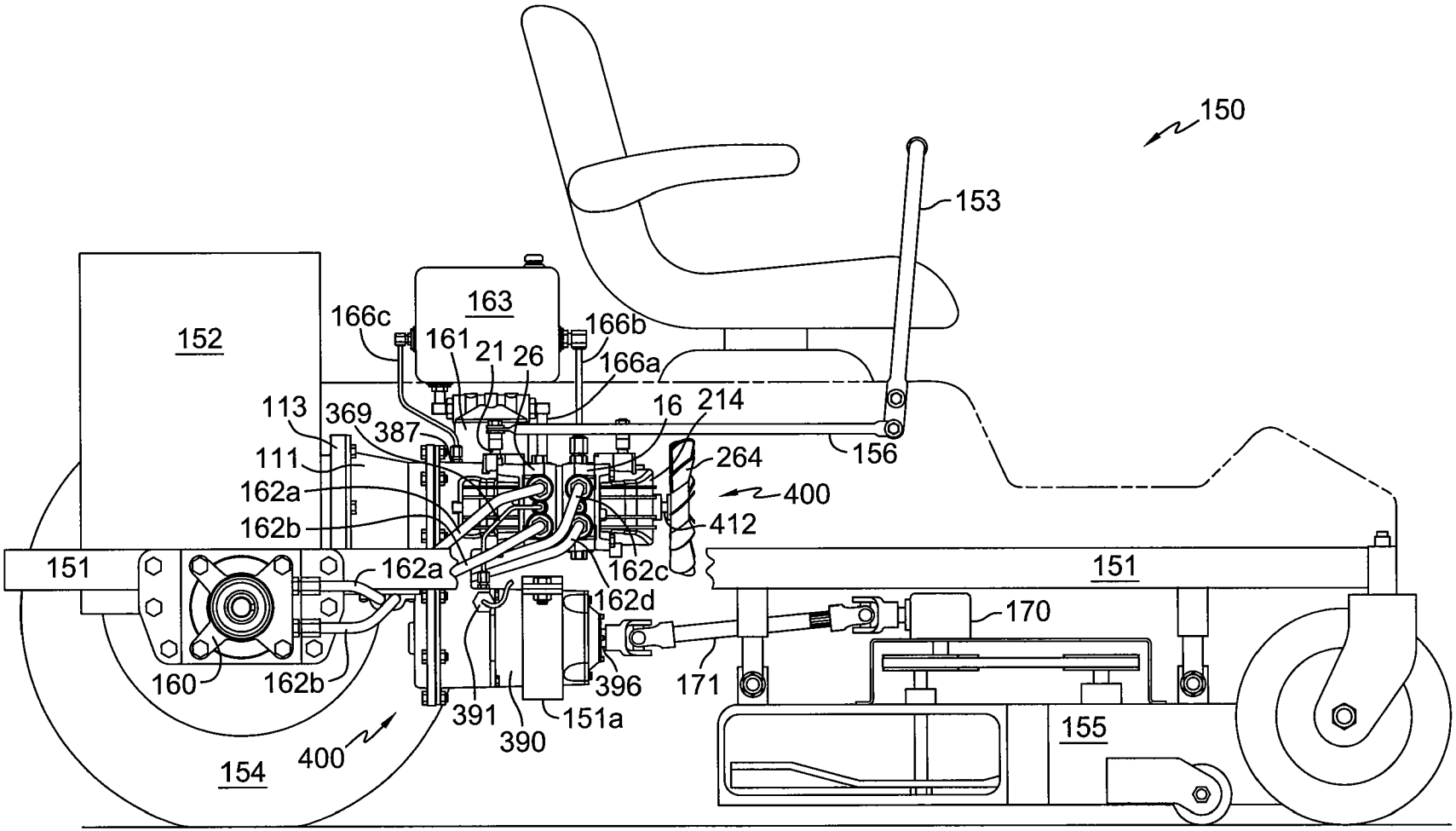
FIG. 9 is an elevational view of an exemplary vehicle incorporating a dual pump apparatus with power take off in accordance with a fifth embodiment of the present invention, the vehicle having certain elements such as a frame rail and wheel removed to show various features of the present invention.

Dual pump apparatus 400, as applied to an exemplary vehicle 150 in FIG. 9, illustrates a fifth embodiment of the present invention having a through-shaft 412 and cooling fan 264. While apparatus 400 is the only dual pump apparatus with power take off depicted with a through-shaft and fan assembly, it is to be understood that the scope of these further embodiments extends to through-shaft designs when application of the present invention requires a forced cooling means such as cooling fan 264. Furthermore, through-shaft applications are not limited to cooling means, as other uses well known in the art are contemplated by the present invention such as providing drive for a gear pump (not shown) to raise or lower the depicted mower deck 155 of exemplary vehicle 150 in FIG. 9.

Figure 10:
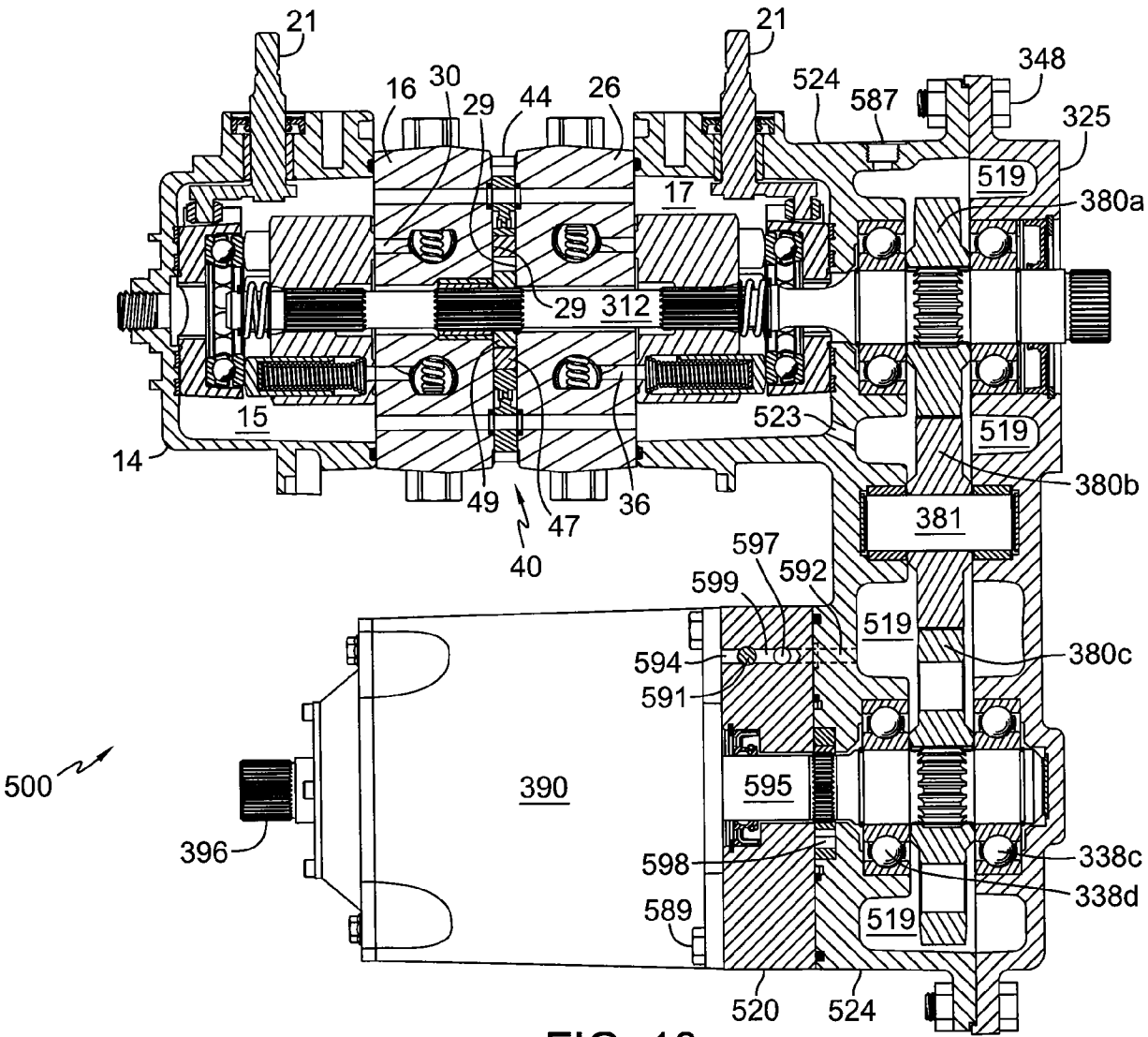
FIG. 10 is a partial cross-sectional view of a dual pump apparatus with power take off in accordance with a sixth embodiment of the present invention.

FIG. 10 depicts dual pump apparatus 500, a sixth embodiment of the present invention in which hydraulic power take off 390 receives pressurized fluid from an additional, dedicated charge pump 598. This arrangement may be required in situations where the hydraulic pressure required to actuate the clutch and brake mechanisms (not shown) of power take off 390 does not correspond with the working pressure generated by charge pump 40.

Figure 11:
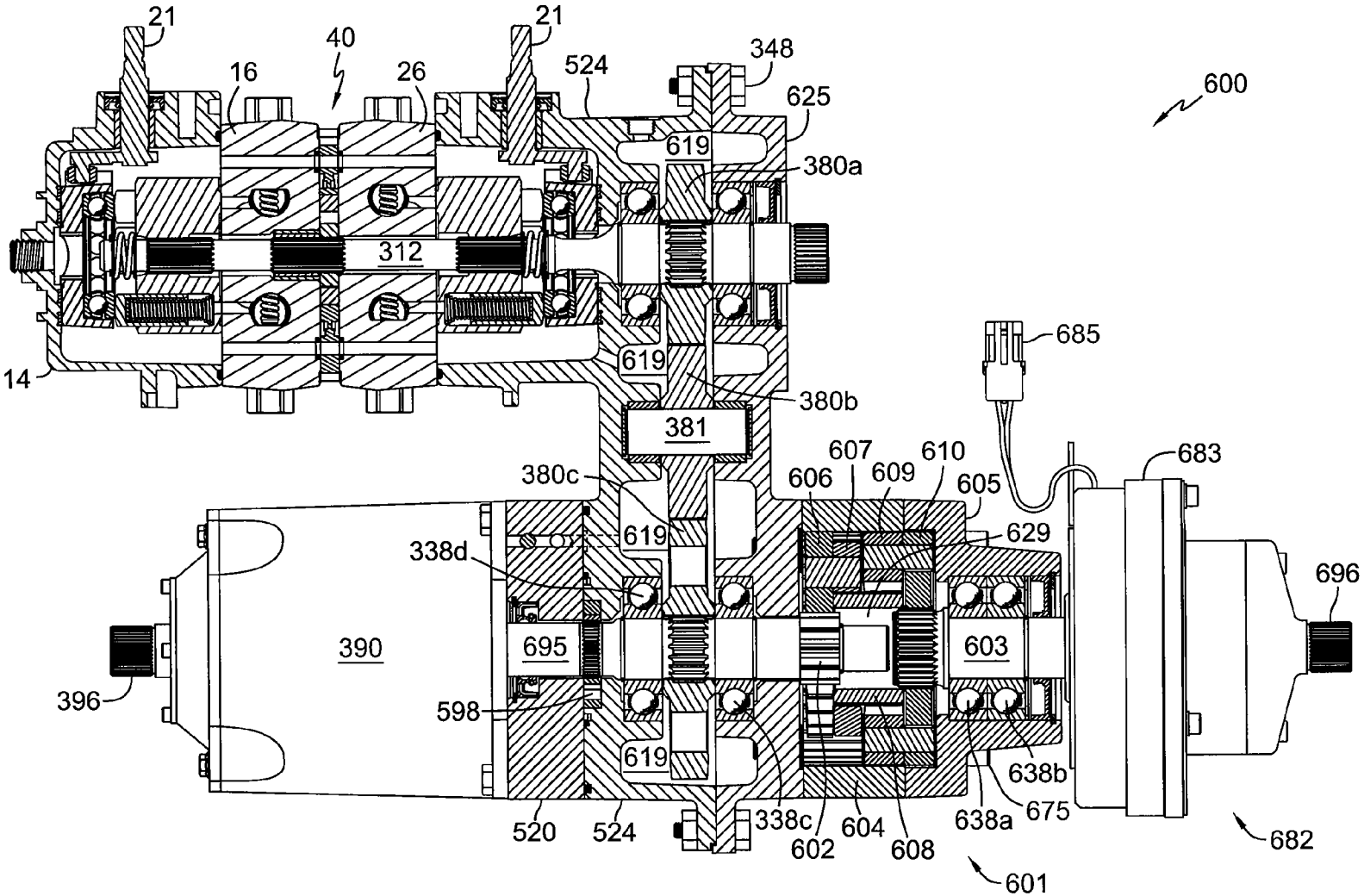
FIG. 11 is a partial cross-sectional view of a dual pump apparatus with power take off in accordance with a seventh embodiment of the present invention.

A final embodiment, dual pump apparatus 600 of FIG. 11, combines the hydraulic power take off and charge pump arrangement of apparatus 500 with a dual planetary reduction 601 to drive an additional electric power take off 682. The details of these embodiments will be described herein.

As shown in FIGS. 7 and 8, dual pump apparatus 300 includes pump/gearbox housing 324 that is joined on a first side to end cap 26 by fasteners 57, in the manner of housing 24 discussed previously. Sump 17 is formed internally to housing 324. On a second side, housing 324 is secured to gearbox housing 325 with fasteners 348 to form gearbox sump 319.

Power take off 390 is also secured to housing 324 by a series of fasteners 389, whereby power take off drive shaft 395 and power take off output shaft 396 are oriented parallel to input shaft 312. Housed within gearbox sump 319 are transmission gears 380*a*, 380*b* and 380*c* that permit input shaft 312 to drive power take off drive shaft 395, preferably at a reduced rate scaled for a given application. Transmission gear 380*a* is fixed to a splined portion of input shaft 312 to thereby rotatably engage and drive gear 380*b*. Jackshaft 381, supported on bushings 382*a* and 382*b*, provides the axis of rotation for gear 380*b*. Gear 380*b* rotatably engages and drives transmission gear 380*c*, which is fixed to a splined portion of power take off drive shaft 395, thereby providing motive force to power take off 390. Power take off drive shaft 395 is supported by various bearings, including 338*c* and 338*d*.

The specific workings of hydraulic power take off mechanisms, such as that referenced in commonly owned U.S. Pat. No. 7,137,250, are well known in the art and shall only be described briefly herein and generally include hydraulic clutches and brake mechanisms, which are not depicted in these figures. Supply line 369 connects charge diagnostic port 76 of end cap 26 with the pressure inlet 393 of power take off 390, providing pressurized hydraulic fluid from a charge gallery (not shown) in end cap 26 to actuate the hydraulic clutch and brake mechanisms (not shown) of power take off 390. It should be understood that supply line 369 could alternatively utilize the charge gallery of end cap 16 depending on, e.g., routing constraints in a given application.

Power take off valve 391, generically depicted herein, may be hydraulic, electro-hydraulic, or mechanical in nature. Such valves, whether manually or remotely actuated, are known in the art and shall not be detailed further. Regardless of configuration, power take off valve 391 operates as a two-position valve, permitting hydraulic fluid to engage the power take off clutch while disengaging its brake mechanism; or alternatively, to vent hydraulic fluid reversing the operations of the clutch and brake mechanisms. Engagement of the clutch mechanism synchronizes power take off output shaft 396 with the rotation of its drive shaft 395. Hydraulic fluid is provided to power take off 390 through pressure passage 394, while hydraulic fluid is vented to gearbox sump 319 through pressure relief passage 392. To accommodate the increase in hydraulic fluid volume generated by operation of power take off 390, a case drain 387 is provided in housing 324. As detailed for apparatus 200, only one case drain 67 need be used for the dual pumps when at least one fluid passage 32, 34 is available to connect fluid sumps 15, 17. Accordingly, FIG. 9 illustrates such an application of the present invention, wherein case drains 387 and 67 return hydraulic fluid to an external reservoir 163. Alternatively, FIG. 8 depicts optional fluid passage 323 which provides fluid communication between internal sump 17 (and thereby internal sump 15) and gearbox sump 319. This communication, as application permits, allows use of a single case drain 387 for the entire apparatus 300, reducing costs associated with additional hoses and fittings. This configuration allows hydraulic fluid containing entrained debris from gearbox sump 319 to be routed back to external reservoir 163 for cooling and subsequent filtering, minimizing any possible contamination of the dual pumps.

FIG. 9 illustrates a second application of the present invention to an exemplary vehicle 150, wherein a fifth embodiment having a power take off, dual pump apparatus 400, is operationally mounted. Apparatus 400 varies from the prior description for apparatus 300 in that unitary pump input shaft 412 is of a through-shaft design. First pump housing 214 permits input shaft 412 to extend out of the housing to power cooling fan 264 in the manner previously described for dual pump apparatus 200. In all other respects, the prior operational description of apparatus 300 applies to apparatus 400. Exemplary vehicle 150 comprises a prime mover 152 mounted on a frame 151. Apparatus 400 is rigidly fixed to prime mover 152 by means of a bell housing 111 and an adapter plate 113. Power take off 390 is also restrained by frame support 151*a*, which serves to minimize movement in high torque situations. Within bell housing 111, prime mover 152 is directly coupled to unitary pump input shaft 412. Further, power take off output shaft 396 is directly coupled to gearbox 170 of mower deck 155 via drive shaft 171. The depicted application of the present invention to a vehicle having a mower deck is exemplary only and not intended to exclude application to other known uses for mobile power take off units including, but not limited to, providing drive for an auger, aerator, spreader, or tiller. The present invention's compact arrangement of dual pumps and integral power take off is preferably suited to direct (horizontal) couplings as depicted in FIG. 9. However, it is to be understood that mounting of the present invention with its pump input shaft 412 in a vertical orientation will permit indirect coupling through the use of belts and pulleys in appropriately configured vehicles or apparatuses.

FIG. 9, wherein several vehicle components have been removed for clarity, further illustrates operational routing for requisite hydraulic lines. A hydraulic motor 160, used to power a drive wheel 154 (removed), is connected to end cap 26 of apparatus 400 by hydraulic lines 162*a* and 162*b*. Hydraulic lines 162*c* and 162*d* place a second hydraulic motor (not shown) in fluid communication with end cap 16 of apparatus 400. Hydraulic line 166*a* routes hydraulic fluid drawn from external reservoir 163 through oil filter 161 to inlet port 65 located on end cap 26. It should be understood that an inlet port 65 of either end cap 16, 26 may be utilized because of the porting associated with shared charge pump 40. Hydraulic lines 166*b* and 166*c* connect two case drains with reservoir 163; case drain 67 located on end cap 16, and case drain 387 located on housing 324. It is to be understood that any of the case drains 67 on the end caps 16, 26 may be utilized in conjunction with case drain 387, depending upon the constraints of a given application, because of the fluid communication between sumps 15, 17. Supply line 369 provides pressurized hydraulic fluid from the charge gallery (not shown) of end cap 26 to actuate power take off 390, the flow of which is controlled by the generically-depicted, power take off valve 391.

An operational control mechanism for one of the dual pumps of apparatus 400 is also illustrated in FIG. 9, wherein linkage 156 connects trunnion arm 21 to control lever 153. It will be understood that a parallel control mechanism (not shown) provides operational control for the other dual pump.

FIG. 10 depicts a sixth embodiment of the present invention featuring a dedicated charge pump 598 that provides pressurized hydraulic fluid to power take off 390. It is to be understood that for apparatus 500, identically or similarly labeled elements perform as previously described for apparatuses 300 and 400. Apparatus 500 comprises, in part, gearbox housing 325 secured to pump/gearbox housing 524 with fasteners 348, thereby forming gearbox sump 519. Charge porting block 520 and power take off 390 are also secured to housing 524 using fasteners 589. The modular nature of charge porting block 520 facilitates integration of charge pump 598 during assembly. As before, gearbox sump 519 contains transmission gears 380*a*, 380*b* and 380*c*, and jackshaft 381, which permit input shaft 312 to drive power take off drive shaft 595. A splined portion of shaft 595 further drives charge pump 598. Charge porting block 520 contains hydraulic porting (not shown) that permits fluid drawn from external reservoir 163 through oil filter 161 to a charge inlet port (not shown) to be pressurized by charge pump 598 and delivered to charge gallery 599 via charge pump outlet 597. Charge pump porting, including a pressure relief valve, a relief passage, and a bleed passage to facilitate cooling as discussed in previously cited U.S. Pat. No. 7,137,250, is well known in the art and will not be described further herein. Power take off valve 591 performs the identical two-position function described above for valve 391, permitting hydraulic fluid to enter pressure passage 594 to engage the power take off clutch (not shown) while disengaging the brake mechanism (not shown), thereby driving output shaft 396; or alternatively, to vent hydraulic fluid to gearbox sump 519 through pressure relief passage 592, reversing the operations of the power take off's clutch and brake mechanisms. Accumulated hydraulic fluid is again returned to external reservoir 163 for cooling and subsequent filtering by way of gearbox case drain 587. Optional fluid passage 523 places internal sumps 15, 17 and gearbox sump 519 in fluid communication, permitting the singular use of case drain 587 for the entire apparatus 500, though various combinations with case drains 67 on end caps 16, 26 may be integrated in the absence of optional fluid passage 523.

FIG. 11 depicts a seventh embodiment of the present invention, where power take off drive shaft 695 drives not only hydraulic power take off 390 and charge pump 598 at a first end, but also drives a dual stage planetary reduction 601 at a second end, thereby providing motive force to electric power take off 682. Planetary reduction systems such as described in commonly owned U.S. Pat. No. 6,811,510, the terms of which are incorporated by reference herein, are known in the art and shall only be briefly described herein. Further, the gear ratios involved in the illustrated planetary reduction may be selected to achieve desired output speeds for a given application. As before, it is to be understood that for apparatus 600, identically or similarly labeled elements perform as previously described.

Apparatus 600 comprises, in part, gearbox housing 625 secured to housing 524 with fasteners 348, thereby forming gearbox sump 619. In combination, shaft housing 605 and a planetary housing with integral ring gear 604 are secured to gearbox housing 625 with fasteners 675, forming internal volume 629. The depicted planetary reduction system is filled with hydraulic fluid, wherein fluid may communicate between internal volume 629 and gearbox sump 619 along power take off drive shaft 695. Alternatively, internal volume 629 may be sealed from gearbox sump 319, permitting dual stage planetary reduction 601 to be lubricated by grease. As with prior embodiments, the gearbox sump 619 contains transmission gears 380*a*, 380*b* and 380*c* and jackshaft 381, which permit input shaft 312 to drive power take off drive shaft 695. The interaction of drive shaft 695 at its first end with hydraulic power take off 390 and the operation of power take off 390 with its dedicated charge pump 598 to selectively drive output shaft 396 are as previously described for apparatus 500.

Near its second end, power take off drive shaft 695 comprises a spline (not shown) upon which primary sun gear 602 is fixed to rotationally engage primary planet gears 606. Primary planet carrier 607, rotated by the interaction of its rotationally mounted planet gears 606 with the integral ring gear of planetary housing 604, further engages and drives secondary sun gear 608. Similar to the primary planet gears, secondary planet gears 609 are engaged and driven by secondary sun gear 608, thereby driving their mounting element, secondary planet carrier 610, by the interaction of the secondary planet gears 609 with the integral ring gear of planetary housing 604. Secondary planet carrier 610 further engages and drives power take off midshaft 603 whose rotation may be selectively coupled to electric power take off output shaft 696. Midshaft 603 is rotationally supported on various bearings, including 638*a* and 638*b* within shaft housing 605.

The specific operation of an electric clutch mechanism 683 within electric power take off 682 is well known in the art and shall only be addressed briefly herein. Application of electric current/voltage to the coil (not shown) of electric clutch 683 is accomplished by linking electrical connector 685 to a switchable source of direct electric current/voltage. Upon application of electric current/voltage, clutch 683 becomes engaged, synchronizing the rotations of midshaft 603 and output shaft 696. When electric current/voltage is cut off, clutch 683 is disengaged, ceasing power transfer to output shaft 696.

While specific embodiments of the present invention have been described in detail, it will be appreciated by those skilled in the art that various modifications and alternatives to those presented herein could be developed in light of the overall teachings of the disclosure. Accordingly, the particular arrangements disclosed are meant to be illustrative only and not limiting as to the scope of the invention which is to be given the full breadth of the appended claims and any equivalent thereof.

What is claimed is:

1. A hydraulic pump apparatus, comprising:

a first pump assembly comprising a first end cap, a first pump housing mounted to the first end cap to form a first sump and a first axial piston pump disposed in the first sump;

a second pump assembly comprising a second end cap, a second pump housing mounted to the second end cap to form a second sump, and a second axial piston pump disposed in the second sump, wherein the axes of rotation of the first and second axial piston pumps are collinear;

a charge pump positioned directly between and engaging both the first and second end caps;

a gearbox comprising a gearbox housing forming a third sump and a plurality of transmission gears rotatably disposed therein;

an input shaft comprising a first end external to the gearbox housing and a second end;

a first transmission gear fixed on and driven by the input shaft; and a power take off mechanism comprising a drive shaft extending into the gearbox to engage and be driven by a second transmission gear fixed on the drive shaft and an output shaft, wherein the drive shaft and output shaft extend in opposite directions from one another and are parallel to the input shaft.

2. The hydraulic pump apparatus of claim 1, wherein the power take off mechanism is directly mounted on a portion of the second pump housing.

3. The hydraulic pump apparatus of claim 1, wherein the gearbox housing comprises a portion of the second pump housing joined to a separate housing member.

4. The hydraulic pump apparatus of claim 1, wherein the input shaft comprises a unitary shaft that engages and simultaneously drives the first and second axial piston pumps, the charge pump and the first transmission gear.

5. The hydraulic pump apparatus of claim 4, wherein the second end of the input shaft extends entirely through the first pump housing.

6. The hydraulic pump apparatus of claim 1, further comprising a first hydraulic circuit formed in the first end cap and a second hydraulic circuit formed in the second end cap, whereby the charge pump provides pressurized hydraulic fluid to both the first and second hydraulic circuits.

7. The hydraulic pump apparatus of claim 6, further comprising an external hydraulic line that connects one of the end caps to the power take off mechanism, whereby pressurized hydraulic fluid drawn from either the first or second hydraulic circuit actuates the power take off mechanism.

8. The hydraulic pump apparatus of claim 7, wherein the gearbox housing comprises a portion of the second pump housing joined to a separate housing member, and a relief passage extends through the portion of the second pump housing to connect the power take off mechanism and the third sump.

9. The hydraulic pump apparatus of claim 8, wherein the power take off mechanism further comprises an inlet passage connected to the external hydraulic line.

10. The hydraulic pump apparatus of claim 9, wherein the power take off mechanism further comprises a valve traversing both the inlet passage and the relief passage, whereby the valve is moveable between a first position that simultaneously opens the inlet passage and closes the relief passage to provide pressurized hydraulic fluid to the power take off mechanism, and a second position wherein the inlet passage is closed and the relief passage is open to vent pressurized hydraulic fluid from the power take off mechanism.

11. The hydraulic pump apparatus of claim 10, wherein the output shaft is released from a stationary position and coupled to and rotated with the drive shaft when the valve is in the first position, and the output shaft is uncoupled from and held stationary in relation to the drive shaft when the valve is in the second position.

12. The hydraulic pump apparatus of claim 1, further comprising a first fluid passage extending through the first end cap, the charge pump and the second end cap to connect the first sump to the second sump.

13. The hydraulic pump apparatus of claim 12, further comprising a case drain located on the third sump.

14. The hydraulic pump apparatus of claim 13, further comprising a second fluid passage extending through the second housing to connect the second sump to the third sump.

15. The hydraulic pump apparatus of claim 1, wherein the input shaft is driven by a prime mover at the first end and extends through the first housing at the second end.

16. The hydraulic pump apparatus of claim 15, further comprising a fan assembly driven by the input shaft at the second end.

17. The hydraulic pump apparatus of claim 1, further comprising a third transmission gear fixedly mounted on a rotatable jackshaft within the gearbox, wherein the first transmission gear engages and drives the third transmission gear which engages and drives the second transmission gear, thereby conveying power from the input shaft to the drive shaft.

18. The hydraulic pump apparatus of claim 17, wherein the outside diameter of the second transmission gear is greater than the outside diameter of the first transmission gear, thereby reducing the rotational speed of the drive shaft relative to that of the input shaft.

19. The hydraulic pump apparatus of claim 1, further comprising a first swash plate and a first trunnion rotatable to move the first swash plate, a second swash plate and a second trunnion rotatable to move the second swash plate, wherein the first and second trunnions extend out from the hydraulic pump apparatus in a direction generally opposite the power take off mechanism.

20. The hydraulic pump apparatus of claim 1, wherein the charge pump has a first position corresponding to a first rotation direction of the input shaft and a second position approximately 180 degrees from the first position corresponding to a second rotation direction of the input shaft.

21. The hydraulic pump apparatus of claim 1, further comprising a second charge pump disposed between the third sump and the power take off mechanism.

22. The hydraulic pump apparatus of claim 21, wherein the gearbox housing comprises a portion of the second pump housing joined to a separate housing member, and the second charge pump comprises a charge porting block mounted to the second pump housing portion and a gerotor disposed within a recess on the second pump housing portion.

23. The hydraulic pump apparatus of claim 22, further comprising a first fluid passage within the charge porting block connecting the second charge pump to the power take off mechanism.

24. The hydraulic pump apparatus of claim 23, further comprising a second fluid passage extending through the charge porting block and the second housing portion to connect the power take off mechanism and the third sump.

25. The hydraulic pump apparatus of claim 24, further comprising a valve within the charge porting block that controls the movement of pressurized hydraulic fluid within the first and second fluid passages, wherein the valve is moveable between a first position that simultaneously routes pressurized hydraulic fluid from the second charge pump to the power take off mechanism through the first fluid passage and prevents release of pressurized hydraulic fluid from the power take off mechanism through the second fluid passage, and a second position, wherein pressurized hydraulic fluid is blocked from the power take off mechanism and vented through the second fluid passage.

26. The hydraulic pump apparatus of claim 25, wherein the output shaft is released from a stationary position and coupled to and rotated with the drive shaft when the valve is in the first position, and the output shaft is uncoupled from and held stationary in relation to the drive shaft when the valve is in the second position.

27. A hydraulic pump apparatus, comprising:

first and second pump assemblies, each pump assembly comprising an end cap, a pump housing mounted to the end cap to form a sump, and an axial piston pump disposed in the sump;

a gearbox having a plurality of transmission gears rotatably disposed therein;

a single input shaft extending into both pump housings and the gearbox to simultaneously drive both axial piston pumps and one of the transmission gears;

a drive shaft having a portion disposed in the gearbox and driven by another of the transmission gears, the drive shaft extending into a power take off housing; and a power takeoff mechanism disposed in the power take off housing and comprising an output shaft extending in the opposite direction from the drive shaft.

28. The hydraulic pump apparatus of claim 27, further comprising a charge pump positioned directly between and engaging both the first and second pump assemblies.

29. The hydraulic pump apparatus of claim 28, wherein each end cap comprises a hydraulic circuit formed therein, and the charge pump is directly engaged to both end caps to provide pressurized hydraulic fluid to both hydraulic circuits.

30. The hydraulic pump apparatus of claim 29, wherein the charge pump may be mounted between the end caps in a first position corresponding to a first rotation direction of the input shaft or a second position approximately 180 degrees from the first position corresponding to a second rotation direction of the input shaft.

31. The hydraulic pump apparatus of claim 27, wherein the gearbox comprises a separate housing member mounted to one of the pump housings to form a third sump.

32. The hydraulic pump apparatus of claim 31, further comprising a dual stage planetary reduction mechanism mounted to the separate housing member opposite the power take off mechanism, wherein the drive shaft further extends through the gearbox to engage and drive the dual stage planetary reduction mechanism.

33. The hydraulic pump apparatus of claim 32, further comprising an electric power take off mechanism engaged to and driven by the reduction mechanism.

34. The hydraulic pump apparatus of claim 33, wherein the electric power take off mechanism comprises an electric clutch and a final shaft selectively driven by application of current to the electric clutch.

35. The hydraulic pump apparatus of claim 28, further comprising a first fluid passage extending through both end caps and the charge pump, to connect the two sumps.

36. The hydraulic pump apparatus of claim 35, wherein the gearbox comprises a separate housing member mounted to one of the pump housings to form a third sump, and a case drain is located on the third sump.

37. The hydraulic pump apparatus of claim 36, further comprising a second fluid passage extending through one of the pump housings to connect one of the pump sumps to the third sump.

38. The hydraulic pump apparatus of claim 27, wherein the input shaft is driven by a prime mover at a first end and extends through one of the pump housings at a second end.

39. The hydraulic pump apparatus of claim 38, further comprising a fan assembly driven by the input shaft at the second end.

40. A hydraulic pump apparatus, comprising:

a first pump assembly comprising a first end cap having first and second opposite surfaces, a first axial piston pump disposed on the first surface, and a first housing mounted to the first surface to form a first sump;

a second pump assembly comprising a second end cap having third and fourth opposite surfaces, a second axial piston pump disposed on the third surface, and a second housing mounted to the third surface to form a second sump;

a charge pump positioned directly between and engaging both the second and fourth surfaces; and an input shaft comprising a first end external to the first housing, a second end external to the second housing and a plurality of internal portions that engage and simultaneously drive the first axial piston pump, the charge pump and the second axial piston pump.

41. A power delivery apparatus, comprising:

a gearbox having a plurality of transmission gears rotatably disposed therein;

a hydraulic pump unit mounted to a first side of the gearbox at a first end thereof, wherein the hydraulic pump unit comprises a pair of hydraulic pump assemblies mounted in an inline relationship;

a pump input shaft driving both pump assemblies and at least one of the transmission gears disposed in the gearbox; and a power take off mechanism disposed on the first side of the gearbox at a second end thereof, the power take off mechanism comprising a drive shaft extending parallel to the input shaft, and engaged to and driven by a second of the transmission gears disposed in the gearbox.

42. The power delivery apparatus of claim 41, wherein the hydraulic pump unit further comprises a first pump assembly having a first end cap, a second pump assembly having a second end cap, and a charge pump mounted between and in fluid communication with the first and second end caps to provide hydraulic fluid to the first and second pump assemblies.

43. The power delivery apparatus of claim 42, wherein the charge pump further provides hydraulic fluid to the power take off mechanism.

44. The power delivery apparatus of claim 42, further comprising a second charge pump mounted between and in fluid communication with the power take off mechanism and the gearbox to provide hydraulic fluid to the power take off mechanism.

* * * * *